US005438897A

United States Patent [19]

Chun

[11] Patent Number: 5,438,897

[45] Date of Patent: Aug. 8, 1995

[54] STRIPPER ARRANGEMENT FOR A PUNCH HOLDER

[75] Inventor: Victor L. Chun, Charlotte, N.C.

[73] Assignee: Murata Machinery, Ltd., Machine Tool Division, Aichi, Japan

[21] Appl. No.: 174,827

[22] Filed: Dec. 29, 1993

[51] Int. Cl.[6] ..... B26D 7/18

[52] U.S. Cl. ..... 83/146; 83/139; 83/698.91

[58] Field of Search ..... 83/139, 138, 140, 141, 83/698.91, 552, 684–686, 145, 146

[56] References Cited

U.S. PATENT DOCUMENTS 3,205,742 9/1965 Williamson ..... 83/698.91
3,719,117 3/1973 Mauk et al. ..... 83/698.1
4,041,817 8/1977 Nelson ..... 83/139
4,316,399 2/1982 Wallis ..... 83/138
4,947,719 8/1990 Whistler ..... 83/698.91
4,993,294 2/1991 Chun et al. ..... 83/139

*Primary Examiner*—Richard K. Seidel
*Assistant Examiner*—Allan M. Schrock
*Attorney, Agent, or Firm*—John R. Benefiel

[57] ABSTRACT

A stripper arrangement for a punch holder which uses an external thread on an end section of the punch holder body to mount either a plastic sleeve press fitted over the external thread or a replaceable steel stripper disc held against the end face of the end section with a steel retainer sleeve threaded onto the external thread. In a first embodiment, a soft tipped set screw secures the steel retainer sleeve. In an alternate embodiment, an O-ring engages the inside of the retainer sleeve to retard unthreading due to vibration, which O-ring also engages the plastic stripper sleeve to augment the friction exerted by the press fit over the external threads.

4 Claims, 3 Drawing Sheets

STRIPPER ARRANGEMENT FOR A PUNCH HOLDER

BACKGROUND OF THE INVENTION

1. Field of the Invention

This invention concerns strippers used with punch holders to enable withdrawal of a punch from a workpiece after the punch has penetrated the workpiece.

2. Description of the Relevant Art

Punch holders are often equipped with a stripper, which comprises a workpiece engaging element having an opening through which the punch passes as it is advanced to penetrate the workpiece. After penetration, the stripper element is held against the workpiece surface by stripper springs as the punch is withdrawn. This insures that the workpiece is not pulled up with the punch if the workpiece grips the punch about the perimeter of the punched opening. The punch is thereby stripped from the workpiece.

Stripper openings are closely matched to the punch shape so as to maintain the flat shape of the workpiece about the perimeter of the punched opening. Thus, strippers must be changed with changes in punches in order to match the stripper punch opening to the particular punch shape.

The mounting of the stripper element should accordingly allow easy removal and installation. Designs which use small loose parts such as screws, snap rings, etc., which are slow to be installed are disadvantageous for this reason.

U.S. Pat. No. 4,646,599 issued Mar. 3, 1987 for a "Hydraulic Punch Press with Workpiece Stripper"; U.S. Pat. No. 4,989,484 issued on Feb. 5, 1991, for a "Punch and Stripper Assembly"; and U.S. Pat. No. 3,530,750 issued on Sep. 29, 1970, for a "Punching Tool Assembly", each show stripper arrangements requiring such extra parts which must be installed.

Soft materials such as urethane plastic must sometimes be employed for the stripper, which is usually of steel, to avoid marring workpieces of such metals as aluminum or brass. For this reason the stripper arrangement employed should allow ready replacement of strippers of steel with those of plastic materials without necessitating the use of a different punch holder.

U.S. Pat. No. 5,176,057 issued on Jan. 5, 1993, for a "Punch Holder with Stripper Arrangement", assigned to the same assignee as the present application, describes a stripper arrangement which allows stripping elements of either steel or plastic to be readily replaced and which does not employ loose parts.

However, the mounting of the stripper element is a sleeve or cap held on the holder with friction generated by contact of an O-ring carried by the holder. This arrangement is not sufficiently secure to resist pulling forces that are sometimes developed, as when an oil film is present causing adhesion to the workpiece. This can cause the stripper sleeve to be pulled off.

It would also be advantageous if steel stripper elements could be made even simpler and lower in cost.

SUMMARY OF THE INVENTION

The stripper arrangement according to the present invention utilizes a reduced diameter end section formed on the holder which end section is externally threaded. In the case of steel strippers, a retainer sleeve is threaded onto the holder end section, while a replaceable simple steel stripper disc is captured by a lip on the retainer sleeve to be held against the end face of the holder. Each stripper disc has a preformed opening complementary to the mating punch shape.

Each stripper disc includes a workpiece contacting face which protrudes beyond the retainer sleeve lip.

The holder end section also has a series of axial slots formed therein one of the slots adapted to receive a stripper disc alignment pin to facilitate alignment of the disc punch opening with the punch.

In one embodiment, a soft tipped set screw is used to prevent vibration induced loosening of the retainer sleeve on the external thread of the holder end section.

In a second embodiment, the retainer sleeve has an internal slope sided peripheral groove which moves into registry over an O-ring held by the punch holder end section as the retainer sleeve becomes fully seated. The O-ring prevents vibration induced loosening of the retainer sleeve.

A one-piece plastic stripper sleeve may be installed on the same holder for the retainer sleeve and steel stripper disc.

The plastic sleeve is press fit over the external thread to be securely retained thereon.

The plastic stripper sleeve has an integral end face which contacts the workpiece, and the punch opening is formed by the punch itself during the first punch cycle.

The plastic stripper sleeve is partially assembled onto the holder end section and is forced upwardly to be fully seated onto the external threads when the punch is initially cycled. The external thread preferably has flattened crests to facilitate the press fitting of the plastic stripper sleeve.

A gap between a step in the holder body and the upper end of the plastic stripper sleeve allows a pry tool to be inserted and used to force the stripper sleeve off the external thread of the holder end section when stripper replacement is necessary.

The O-ring arrangement can be used with the plastic stripper sleeve, the O-ring functionally engaging the inside diameter of the plastic stripper to augment the frictional retention forces generated between the flattened crest external thread and inside diameter of the plastic retainer sleeve.

DETAILED DESCRIPTION

In the following detailed certain specific terminology will be employed for the sake of clarity and a particular embodiment described in the accordance with the requirements of 35 USC 102, but it is to be understood that the same is not intended to be limiting and indeed should not be so construed inasmuch as the invention is capable of taking many forms and variations within the scope of the appended claims.

Figure 1:
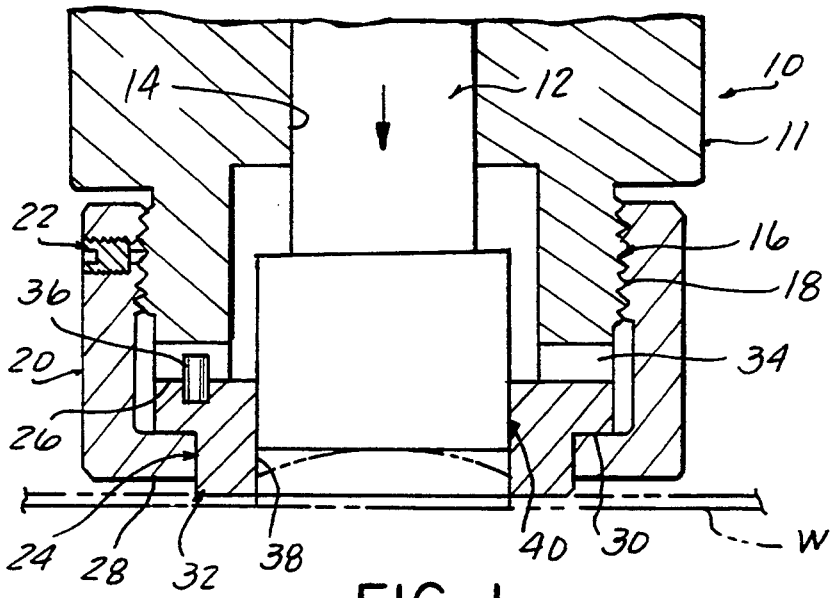
FIG. 1 is a fragmentary view of a partial section taken through a punch holder showing a stripper arrangement according to the present invention installed thereon.

Referring to the drawings and particularly FIG. 1, a generally cylindrical punch holder body 11 of a punch holder assembly 10 is shown in section. The punch holder body 11 mounts a punch 12, which is adapted to be stroked within a bore 14 in the punch holder body 11 during the punching operation.

Other details of the punch holder assembly are not described herein inasmuch as such punch holder assemblies are well known in the art. A suitable punch holder assembly is shown in U.S. Pat. No. 5,176,057 issued on Jan. 5, 1993, for a "Punch Holder With Stripper Arrangement" with which the present stripper arrangement invention can be employed.

The punch holder body 11 includes a reduced diameter end section 16 which has an external thread 18 formed thereon. Threadably advanced on the external thread 18 is an internally threaded stripper retainer sleeve 20.

The retainer sleeve 20 is engaged by means of a soft tipped set screw 22 to prevent loosening as from vibration.

A stripper disc 24 is held against the end face 26 of the holder end section 16 by the stripper retainer sleeve 20, the retainer sleeve 20 having an inwardly projecting lip 28 which overlies and captures a flange rim 30 of the stripper disc 24.

The stripper disc includes a projecting end face 32 which protrudes beyond the lip 28 such as to be able to contact the surface of the workpiece to be punched.

Figure 1A:
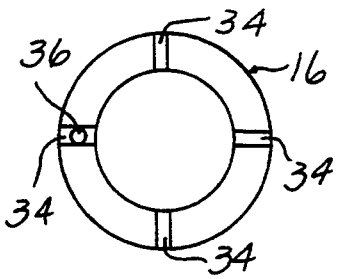
FIG. 1A is an end view of the holder end section shown in FIG. 1.

The holder end section 16 is formed with four equally symmetrically arranged slots 34 recessed axially into the end face of the holder end section 16 and radially extending from the center of the holder 10 as shown in FIG. 1A.

The slots 34 are each adapted to receive an alignment pin 36 carried by the stripper disc 24. The purpose of the alignment pin 36 is to provide a means to ensure the accurate orientation of a punch accommodating opening 38 which is preformed in the stripper disc 24. Both the retainer sleeve 20 and stripper disc 24 are preferably constructed of steel and the stripper disc 24 has an opening which is close fit to the punching head 40, and hence must be accurately oriented to receive the punch head 40. At assembly, the stripper disc 32 is rotated to the approximate correct position, and the pin 36 inserted in the nearest slot to provide a precision angular location.

The stripper disc 32 can be manufactured very inexpensively inasmuch as it can be constructed from flat steel stock having pieces formed with openings suitably complementary to the shape of the variously shaped punches required. The one piece steel sleeves previously employed are much more costly to produce. The common retainer sleeve 20 can be employed for a variety of replaceable stripper discs 24.

Figure 1B:
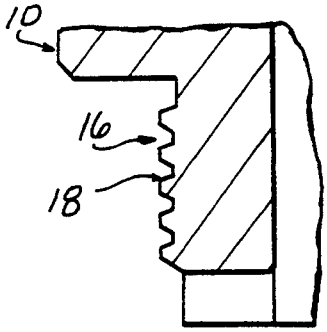
FIG. 1B is a fragmentary enlarged view of the holder end section shown in FIG. 1 illustrating the flattened crest external thread formed thereon.
Figure 2:
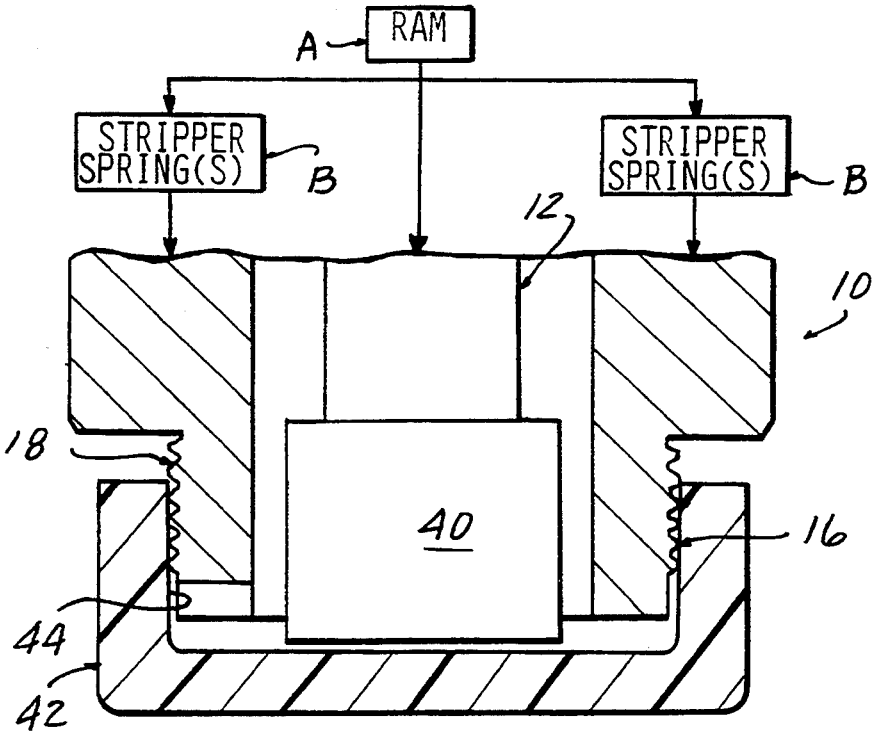
FIG. 2 is a fragmentary view of a section taken through a punch holder showing a plastic stripper sleeve partially seated thereon.

Referring to FIG. 2, the same holder may be employed to receive a one-piece plastic stripper sleeve 42, shown partially seated on the holder end section 16. In this case, the plastic stripper sleeve has an internal diameter 44 which is sized to be pressed fit over the external threads 18 formed on the holder end section 16. For this reason, the external threads 18 are preferably flattened at their crest as shown in FIG. 1B.

The stripper sleeve 42 may be formed during use with the punch head accommodating opening in similar fashion to that described in aforementioned U.S. Pat. No. 5,176,057.

The press ram, shown diagrammatically, acts directly on the punch 12 to drive the punch head downwardly as the ram 15 descends. The ram 15 acts on the punch body 11 via compressible stripper springs 17, also shown diagrammatically, so that the punch holder body 11 can stop once the stripper sleeve 42 is fully seated and engaged with the workpiece, while the punch 12 continues to be advanced.

Figure 3:
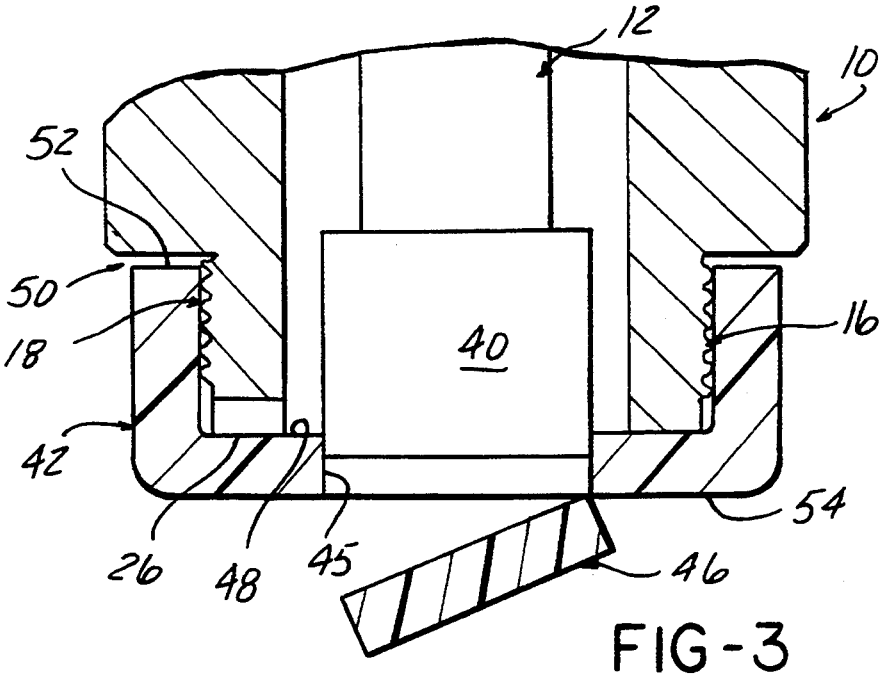
FIG. 3 shows the partially sectional view of the punch holder of FIG. 2, with the plastic sleeve fully seated and a punch opening formed, with a slug from the stripper sleeve end shown displaced by the punching action.

As shown in FIG. 3 when the punch head 40 is forced through the end face of the plastic retainer stripper sleeve 42, against a die, not shown, the slug 46 formed thereby drops away after the punch 40 has been retracted subsequent to an initial punching cycle.

In FIG. 3, the plastic stripper sleeve 42 has been fully seated with its internal end face 48 pressed against the end face 26 of the holder end section 16. The frictional engagement with the series of threads comprising the external thread 18 provides a very secure retention of the plastic stripper sleeve 42 on the reduced diameter holder end section 16.

A gap 50 is provided between a larger diameter section of a holder 10 and the upper end face 52 of the plastic stripper sleeve 42 to allow insertion of a pry tool (not shown) and convenient removal of the plastic stripper sleeve 42 when replacement is necessary.

The entire integral end face 54 of the plastic stripper sleeve contacts the workpiece and is held against the workpiece by the stripper springs 17 during withdrawal of the punch 12 to provide the stripping function.

Accordingly, it can be appreciated that no separate loose and/or difficult to assemble parts are required and the arrangement adapts easily to either steel or plastic stripper elements.

The steel stripper disc can be constructed at low cost.

Figure 4:
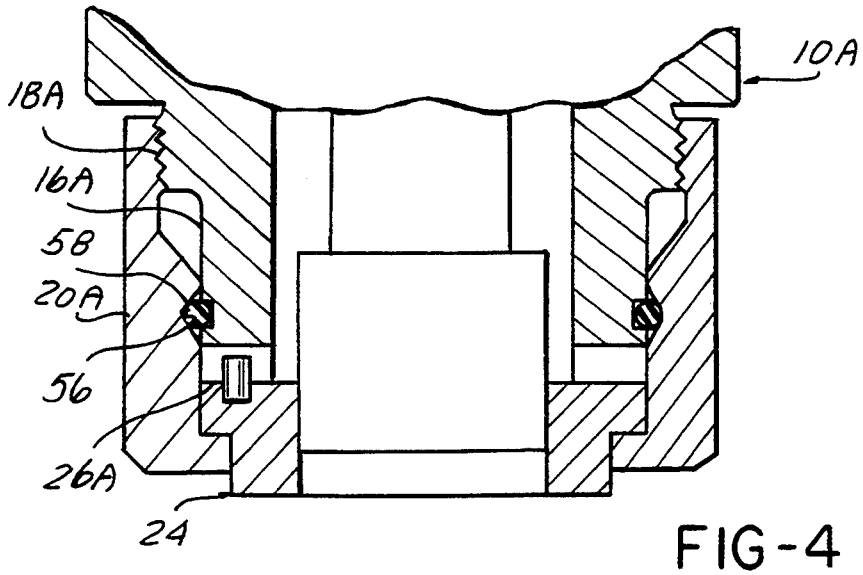
FIG. 4 is a fragmentary sectional view of the end of a punch holder showing an alternate form of the stripper arrangement according to the present invention installed thereon.

FIG. 4 illustrates an alternate embodiment in which the retainer sleeve 20A is provided with a slope sided internal groove 56 which moves into registry with an O-ring 58 acting as a retainer, carried in a square sided groove in the holder end section 16A. Thus, as the retainer sleeve 20A is advanced on an external thread 18A, the O-ring 58 enters groove 56 as the stripper disc 24 is seated against the end face 26 of the holder end section 16A.

The O-ring 56 in entering the groove 56 thereafter serves as an antivibration retention element tending to resist unthreading of the retainer sleeve 20A on the external threads 18A.

Figure 5:
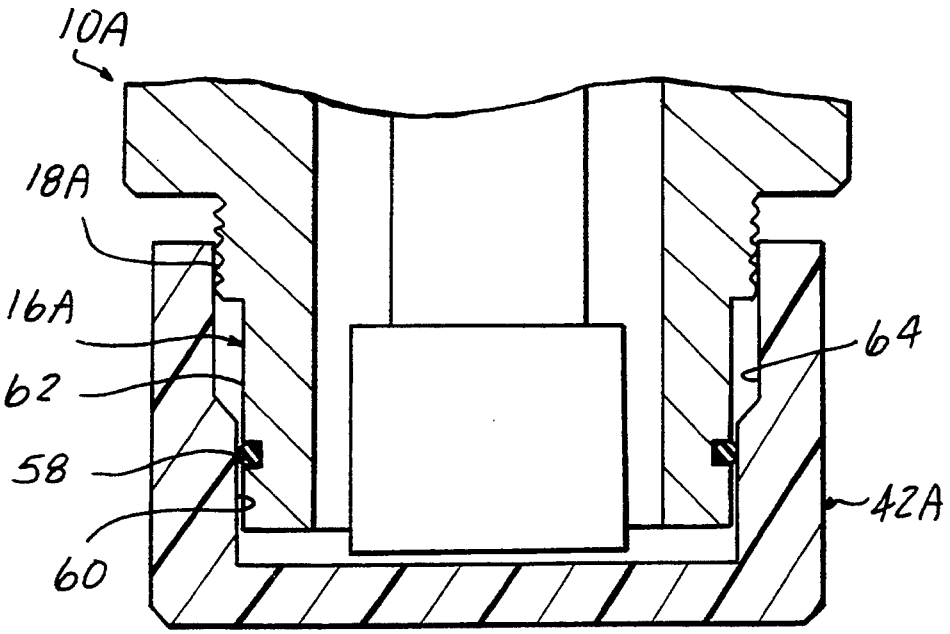
FIG. 5 is a fragmentary partially sectional view of the holder end section shown in FIG. 4 with a plastic stripper sleeve partially seated thereon replacing the steel retainer sleeve and insert disc shown in FIG. 4.
Figure 6:
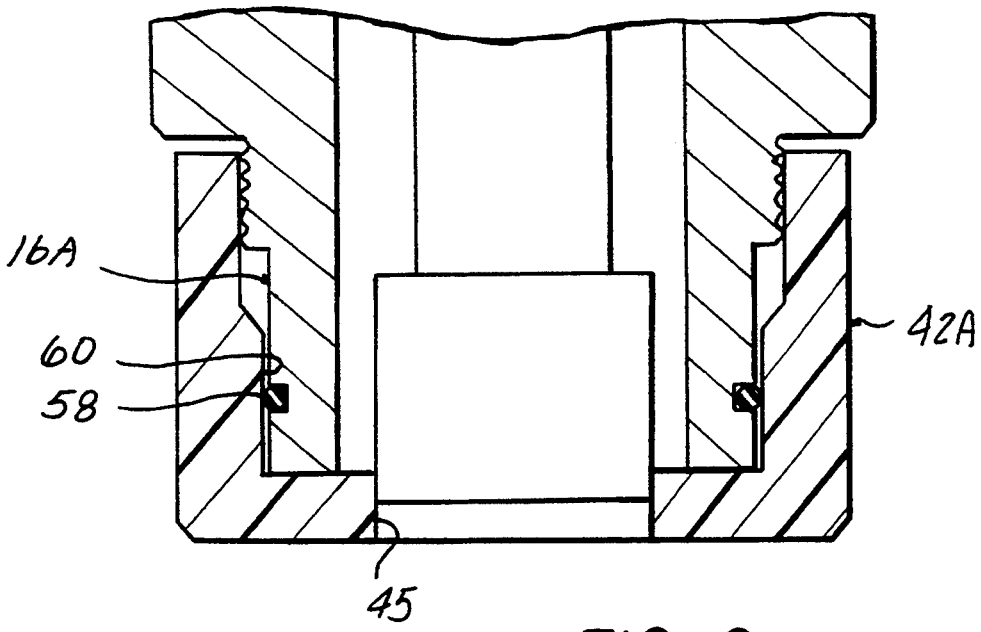
FIG. 6 shows the plastic stripper sleeve and holder end section shown in FIG. 5 in the fully seated position.

FIGS. 5 and 6 show that a plastic retainer sleeve 42A may also be readily substituted on the same holder configuration. In this case, the O-ring 58 frictionally engages the inside surface 60 of the plastic stripper sleeve 42A. A slight clearance is provided between the inside diameter 60 and the outside diameter 62 of the holder end section 16A into which the O-ring 58 is compressed.

The larger inside diameter 64 again can be press fit to the external threads 18 to create a secure frictional retention force and augmented by the frictional force generated between the compressed O-ring 58 and inner diameter 60.

The plastic retention sleeve 42A is seated by the initial punch cycle which also forms the punch accommodating opening 45 as in the above described embodiment.

In operation, the punch holder 10 is engaged with a press ram 15. When the press ram 15 is actuated, the punch holder 10 is lowered towards a workpiece W supported on a press table (not shown). The punch holder 10 mounts the punch 12 so as to be relatively movable against the resistance of the stripper spring force such that the end face of the stripper disc 32 or stripper sleeve 42 engages the workpiece W and the punch 12 continues to be advanced to be extended out of the punch holder and penetrate the workpiece W to form the opening therein.

As the press ram 15 retracts, the spring force of the stripper springs 17 holds the punch holder body 11 and stripper elements 32, 42, against the upper surface of the workpiece W such that the punch 12 can be withdrawn from the workpiece W.

Upon continued elevation of the punch holder 10, the entire punch holder assembly 10 is raised out of engagement with the workpiece W, and the workpiece W is indexed to the next working position.

Inasmuch as this operation is very well known in the art and fully described in the prior art patents referenced above, the details concerning the mating of the punch holder with the ram and the stripper spring arrangement are not herein described.

I claim:

1. A stripper arrangement for a punch holder comprising a punch holder body and a punch relatively movable in a bore in said punch holder body, said punch having one end extended out of said punch holder bore at a lower end of said punch holder body to penetrate a workpiece disposed below said punch holder body as said punch holder is driven downwardly into engagement with said workpiece, said punch holder body having an end section at said lower end, said end section formed with an end face and an external thread, a stripper element comprising a steel stripper disc positioned abutting against said end face of said holder body end section, said stripper disc having an opening closely fit to said punch, a retainer sleeve threadly engaging said external thread on said punch holder end section and having an inward lip portion overlying a perimeter flange on said stripper disc to hold the same when said retainer sleeve is advanced along said external thread, said stripper disc thereby fixedly held in abutment against said punch holder end section end face, said stripper disc including a central portion protruding axially beyond said lip of said retainer sleeve, to contact said workpiece as said punch holder is driven downwardly.

2. The stripper arrangement according to claim 1 further including means resisting unthreading movement of said retainer sleeve on said external thread.

3. The stripper arrangement according to claim 2 wherein said end section of said holder body carries an O-ring, said O-ring engaging the inside of said retainer sleeve to resist rotation of said retainer sleeve to comprise said means resisting unthreading movement of said retainer sleeve.

4. The stripper arrangement according to claim 1 wherein said end face of said punch holder body end section is formed with at least one axially and radially extending slot, said stripper disc having an alignment pin mounted thereto extending axially into said slot.

* * * * *